US009439020B2

(12) United States Patent
Thiele

(10) Patent No.: US 9,439,020 B2
(45) Date of Patent: Sep. 6, 2016

(54) AUDIO SIGNAL PROCESSING UNIT AND AUDIO TRANSMISSION SYSTEM, IN PARTICULAR A MICROPHONE SYSTEM

(75) Inventor: Markus Thiele, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 1085 days.

(21) Appl. No.: 13/240,055

(22) Filed: Sep. 22, 2011

(65) Prior Publication Data

US 2012/0140944 A1 Jun. 7, 2012

(30) Foreign Application Priority Data

Dec. 7, 2010 (DE) ..... 10 2010 062 528

(51) Int. Cl.
*H04S 7/00* (2006.01)
*H04R 3/00* (2006.01)

(52) U.S. Cl.
CPC . *H04S 7/30* (2013.01); *H04R 3/00* (2013.01); *H04R 2420/07* (2013.01); *H04S 2400/13* (2013.01); *H04S 2400/15* (2013.01)

(58) Field of Classification Search
CPC ..... H03G 3/00; H03G 3/005; H03G 3/3005; H03G 3/3068; H03G 7/002; H03G 7/008; H04B 1/76; H04R 3/00; H04R 2420/07; H04S 7/30; H04S 2400/13; H04S 2400/15
USPC ..... 381/77, 80–81, 98, 101–102, 104–107, 381/120; 700/94
See application file for complete search history.

(56) References Cited

U.S. PATENT DOCUMENTS

| | | | | |
|---|---|---|---|---|
| 7,693,289 | B2 * | 4/2010 | Stathem et al. | 381/58 |
| 2004/0106398 | A1 | 6/2004 | Statham et al. | |
| 2009/0046803 | A1 * | 2/2009 | Meyer et al. | 375/295 |
| 2010/0189273 | A1 | 7/2010 | Statham et al. | |

FOREIGN PATENT DOCUMENTS

| | | |
|---|---|---|
| DE | 102004052296 | 5/2006 |
| EP | 1406224 | 4/2004 |

* cited by examiner

*Primary Examiner* — Duc Nguyen
*Assistant Examiner* — Alexander Eljaiek
(74) *Attorney, Agent, or Firm* — Frommer Lawrence & Haug LLP

(57) ABSTRACT

The invention concerns an audio signal processing unit including a receiving unit adapted to receive at least a first audio signal and a pilot tone signal, a first audio signal amplifier adapted to obtain at least a second audio signal from an audio signal source by way of an audio signal input, and a pilot tone signal unit adapted to obtain the received pilot tone signal. The pilot tone signal unit is adapted to output a control signal in a first state if the pilot tone signal is received, and to output the control signal in a second state if the pilot tone signal is not received. The first audio signal amplifier is adapted to process the at least second audio signal in dependence on the state of the control signal.

15 Claims, 1 Drawing Sheet

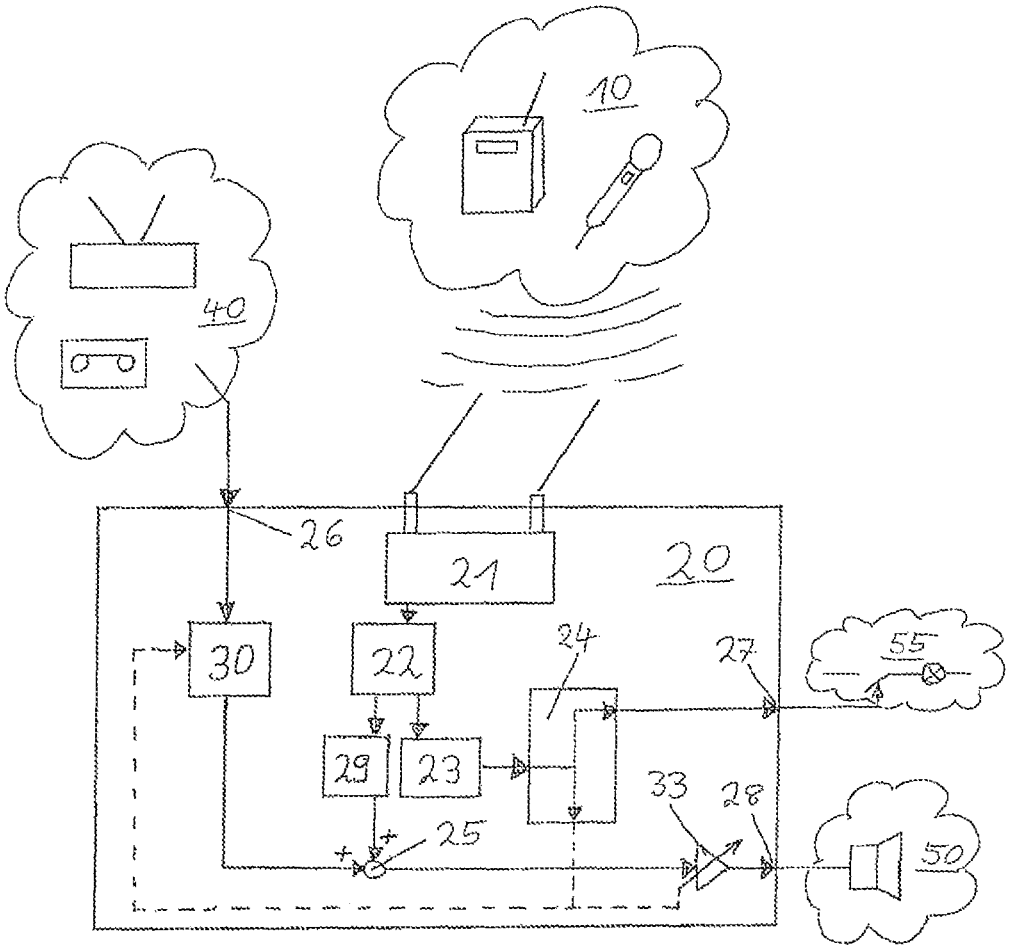
10
40
26
21
20
30
22
24
27
55
29
23
33
28
25
50

AUDIO SIGNAL PROCESSING UNIT AND AUDIO TRANSMISSION SYSTEM, IN PARTICULAR A MICROPHONE SYSTEM

The present application claims priority from German Patent Application Nos. DE 10 2010 062 528.0 filed on Dec. 7, 2010, the disclosure of which is incorporated herein by reference in its entirety.

BACKGROUND OF THE INVENTION

1. Field of the Invention

The present invention concerns an audio signal processing unit and an audio transmission system, in particular a microphone system.

2. Description of Related Art

Audio signal processing units are known hitherto in various configurations, which together with a pickup unit such as a microphone can form an audio signal transmission system, in particular a microphone system. They have a pickup unit like a microphone to pick up an audio signal and pass it in wired or wireless fashion to the audio signal processing unit. That audio signal processing unit can subject that received audio signal to further processing itself such as for example it can filter it, record it, output it or pass it to corresponding further units such as a recording device, a filter, a mixing console, a loudspeaker or the like. That audio signal processing unit can also combine the audio signal received from the pickup unit itself with at least one further audio signal and record the joint combined signal, filter it, subject it to further processing or output it.

What is common to all the above-described audio signal processing units is that operation in order to influence the audio signal received from the pickup unit and/or further audio signals has to be implemented directly at the audio signal processing unit itself. Alternatively it is also possible, by means of a mixing console or the like which obtains from the audio signal processing unit the audio signal received from the pickup unit or a further audio signal or also an audio signal combined from those audio signals, to influence that audio signal or signals. Those influences include muting the pickup unit for example by the audio signal received from the pickup unit not being recorded, filtered, subjected to further processing or outputted. Equally, conversely, a further audio signal may not be recorded, filtered, subjected to further processing or outputted, so that only the audio signal received from the pickup unit is recorded, filtered, subjected to further processing or outputted. It is also possible for example for those signals to be combined together by way of a mixing console. Thus for example the sound and/or the level of a further audio signal can be controlled depending on whether a user does or does not talk into the pickup unit.

Those functions of a selection between various audio signals which are fed to the audio signal processing unit and also combining those audio signals by mixing them or by bringing them together is generally implemented in the form of a manual control by means for example of the audio signal processing unit or a mixing console with operating elements such as for example switches, sliding or rotary controllers. In that respect the operating elements are to be operated by a user to implement those functions. A disadvantage in that respect is that a second person is necessary beside the speaker to operate the audio signal processing unit or the mixing console, or that the speaker must have direct access to the audio signal processing unit or the mixing console and is correspondingly restricted in his freedom of movement.

Automatic muting of an output signal or an automatic reduction in a first audio signal when reaching a predetermined threshold value for the level of a second audio signal is also known, in which level reduction is effected for example in aviation headsets for external sound sources, for example during radio communication. A disadvantage here is that this mode of operation is susceptible to error as that automatic system also reacts in part to interference noises or switches into the mute state with a serious delay. The user can also not specifically targetedly control automatic muting or the automatic lowering of level. In addition known (aviation headset) systems only influence the level of the first audio signal source but do not afford any function for complete muting thereof.

Also known is an automatic mute function by means of a pilot tone signal evaluator (command function). In that respect in telecommunications the term pilot tone signal denotes a signal (generally a single frequency) which is transmitted outside and independently of the actual useful signal by way of a communication channel. That signal serves for checking, control, reference or monitoring purposes. Wireless microphones communicate for example with a pilot tone signal (switchable pilot tone signal monitoring) inter alia items of information such as a battery status check or the MUTE, switch status of the transmitter, that is to say the pickup unit or the microphone, to the receiver. Those data communicated by means of the pilot tone signal are evaluated in the pilot tone signal decoder of the receiver and displayed at the display of the receiver.

In that respect that command function or the pilot tone signal evaluator can be used in professional equipment for muting the audio signal of the pickup unit. A disadvantage in that case is that such systems can only use the pilot tone signal tests for muting and do not offer any mixing function with other audio signal sources.

Evaluation of the pilot tone signal (mute state) can also be effected by way of remote control software. That however can only represent the pilot tone signal, in contrast actions have to be performed by the user. In addition that networking is at the present time possible only with the devices having such remote control software, which however are more expensive than devices without it.

As general technological background attention is directed to DE 10 2004 052 296 A1 and EP 1 406 224 A2.

SUMMARY OF THE INVENTION

Therefore the object of the present invention is to provide a simpler possible way for the user of an audio signal processing unit to influence the relationship of at least two audio signals.

Thus there is provided an audio signal processing unit having a receiving unit which receives at least a first audio signal and a pilot tone signal. The audio signal processing unit has a first audio signal amplifier adapted to receive at least a second audio signal from an audio signal source by way of an audio signal input. The audio signal processing unit also has a pilot tone signal unit adapted to receive the pilot tone signal and output a control signal in a first state if the pilot tone signal is received and to output the control signal in a second state if the pilot tone signal is not received. The first audio signal amplifier is adapted to process the at least second audio signal in dependence on the state of the control signal.

An advantage of the audio signal processing unit of the invention is that the presence and the absence of the pilot tone signal can be used to act on processing of the at least second audio signal by the first audio signal amplifier. In that case the first audio signal amplifier can for example perform the functions of an amplifier, an equalizer, an expander, a compressor, a noise gate or an automatic gain control. Thus the pilot tone signal which in many audio signal processing units is received in any case in order for example to provide a feedback like a battery status or the state of a mute button from a pickup unit like a microphone to the audio signal processing unit like an amplifier can be used for a further purpose, for example in order thereby to adjust the volume of the audio signal of a second audio signal source like a CD player, DVD player or the like. In that case evaluation of the pilot tone signal is effected by the pilot tone signal unit as to whether the usual continuous transmission of the pilot tone signal from the pickup unit is or is not interrupted. Interruption in the pilot tone signal can be effected by a corresponding function of the pickup unit, for example a microphone, or by the pickup unit being switched off, that is to say both the pilot tone signal and also the first audio signal is interrupted.

In accordance with the invention that can provide for indirect operation of the audio signal processing unit in respect of an absolute or relative volume change, two different settings for signal filtering or also other effects in respect of the second audio signal, instead of as previously having to effect corresponding direct operation of that function which hitherto can only be effected at the audio signal processing unit itself. According to the invention for that purpose a signal which is already present, namely the pilot tone signal, is also used, so that simple implementation without major complication and expenditure in terms of modification on known audio signal processing units is required. In that way the audio signal processing unit according to the invention can be used with conventional microphones which can emit a pilot tone signal and the emission of which can be interrupted (mute function) by the user alone or together with the first audio signal, or can be switched on and off. Thus the pilot tone can perform a dual function. The difference between the presence, that is to say existence, and absence, that is to say non-existence, of the pilot tone signal can also be established with simple means so that a reaction to that difference can be easily implemented, that is to say it requires only a slight degree of technical complication and effort.

In that respect according to the invention two different settings are effected for the first and second state of the control signal in the audio signal processing unit, that is to say for the situation involving the presence of the pilot tone signal a first processing setting is selected while a second processing setting is selected for the situation involving absence of the pilot tone signal. According to the invention it is possible to switch over between those two preliminary settings for signal processing by the presence and absence of the pilot tone signal, for example by interrupting the continuous transmission of the pilot tone signal. In contrast hitherto the changes in the setting in respect of signal processing or switching over between different preliminary settings thereof had to be effected directly at the audio signal processing unit by the user or a further person.

In an aspect of the invention the first audio signal amplifier is adapted in accordance with the first state of the control signal to amplify or attenuate the at least second audio signal with a first level and/or to perform filtering with a first frequency spectrum, and in accordance with the second state of the control signal to amplify or attenuate the at least second audio signal with a second level and/or to perform filtering with a second frequency spectrum.

In that way, by virtue of the presence or absence of the pilot tone signal, it is possible to switch over between two different signal processing modes which differ for example in their respective level and/or in filtering of the input signal, that is to say the at least second audio signal. In that respect for example the degree of attenuation of the level of the second audio signal can be set as an absolute value in dB or as a relative percentage value in respect of the unattenuated second audio signal in the audio signal processing unit.

Thus for example in the presence of the pilot tone signal greater amplification can be effected than in the absence of the pilot tone signal so that in the absence of the pilot tone signal the second audio signal is outputted with a lower level from the first audio signal amplifier than in the presence of the pilot tone signal. Thus by interrupting the pilot tone signal a user can for example reduce the level of a piece of music as the second audio signal in order to emphasize his voice in relation to the second audio signal, that is to say to lower the music so that his voice is heard without completely switching off the music or completely lowering the level thereof. In that way for example an announcement can be made by the user without the user or anyone else having to make a corresponding adjustment at the audio signal processing unit such as for example a mixing console.

In addition different filtering of the first audio signal can be effected in the presence of the pilot tone signal than in the absence thereof. That means that the second audio signal amplifier is adapted to amplify or attenuate at least a part of the frequency spectrum of the at least second audio signal. That makes it possible to implement influencing to the effect that it is possible to influence a part of the frequency spectrum of the at least second audio signal by means of the pilot tone signal. Thus for example in the absence of the pilot tone signal a different or additional frequency range can be filtered out in comparison with the filter setting which is implemented when the pilot tone signal is present. Thus the user of a microphone can for example fade the frequency range of the human voice out of a piece of music with singing as the second audio signal and take over the singing by his own performance in order thus for example to switch on a karaoke function by virtue of the absence of the pilot tone signal without the user or anyone else having to make a corresponding adjustment at the audio signal processing unit like for example a mixing console.

In an aspect of the invention the first audio signal amplifier is adapted to completely suppress the at least second audio signal. In that way a mute function can be implemented in respect of the second audio signal, by means of the pilot tone signal. Thus the at least second audio signal can be switched off by the absence of the pilot tone signal so that for example a piece of music as the at least second audio signal can be interrupted if a user would like to talk.

In a further aspect of the invention the audio signal processing unit has an audio signal summing means adapted to obtain the at least second audio signal from the second audio signal amplifier and to sum the at least first audio signal and the at least second audio signal. By means of that audio signal summing means the two audio signals can be summed and then outputted as a joint audio signal by the audio signal processing unit. In that case the relationship of the levels of the two audio signals with respect to each other is determined by the amplification gain by the first and/or second audio signal amplifier, wherein at least the latter is controlled by the pilot tone signal. Thus the pilot tone signal has a direct influence on the audio output signal which the audio signal summing means outputs.

In an aspect of the invention the audio signal processing unit has a second audio signal amplifier adapted to obtain the summed audio signal from the audio signal summing means and to amplify or attenuate the summed audio signal. In that way the summed audio signal can be amplified as a whole to be outputted with a desired gain without the relationship of the two audio signals within the summed audio signal being altered by that amplification effect.

In a further aspect of the invention the audio signal processing unit has an audio signal treatment unit adapted to obtain the at least first audio signal and the received pilot tone signal from the receiving unit and to output the at least first audio signal to the audio signal summing means and the received pilot tone signal to the pilot tone signal unit. The two received signals of the at least first audio signal and the pilot tone signal are separated from each other by means of that audio signal treatment unit so that they can be outputted separately to different units within or outside the audio signal processing unit.

The present invention also concerns an audio signal processing unit comprising a receiving unit adapted to receive at least a first audio signal and a pilot tone signal, and a pilot tone signal unit adapted to obtain the pilot tone signal. The pilot tone signal unit is further adapted to output a control signal in a first state by way of an output of the audio signal processing unit if the pilot tone signal is received, and to output the control signal in a second state by way of the output of the audio signal processing unit if the pilot tone signal is not received.

An advantage of that audio signal processing unit according to the invention is that the presence and absence of the pilot tone signal can be used to generate a control signal and to make it available by way of an output in order to act by way of that control signal for example on an external device. Such an external device can be the control of a light installation, an individual light effect device, a fog machine or the like. Hitherto such devices had to be operated manually, for example by the speaker who is using a microphone, or another person. In that respect the switching-on and switching-off procedures have to be effected at the device itself or by way of a suitable control, for example a joint control, like a mixing console or the like.

That effort on the part of a number of people or simultaneous manual operation of such a device by the speaker while talking into a microphone can be avoided in accordance with the invention by use of the pilot tone signal, by the presence and the absence of the pilot tone signal being used to feed an external device with a control signal having two states corresponding to the presence and the absence of the pilot tone signal. The external device can then be provided to suitably react to that control signal, whereby control of an external device can be effected by the presence and the absence of the pilot tone signal.

In a further aspect of the invention, in accordance with the first state of the control signal an external switching device connected to the output of the audio signal processing unit is put into a first state, and in accordance with the second state of the control signal the external switching device connected to the output of the audio signal processing unit is put into a second state.

In this case also a distinction is made to the effect of whether the pilot tone signal is or is not present, that is to say whether for example the usual continuous emission of the pilot tone signal of the pickup unit is interrupted to specifically targetedly actuate the audio signal processing unit. In that case a switching process in respect of an external switching device is effected in dependence on the presence and the absence of the pilot tone signal. In that way it is possible for devices which are not a component part of the audio signal processing unit and which also involve different functionalities from the audio signal processing effect can also be actuated and influenced, for example switched, by the audio signal processing unit according to the invention. Thus for example devices for producing light effects or illumination or the like can be switched on and off by means of the pilot tone signal or can also be directly actuated to trigger an effect in response to the pilot tone signal.

For example a fog machine or a light effect device can be switched on or off or a light control system can be switched to and fro between two illumination settings set there. The user of a microphone can select a first illumination setting of a light control system in that way, for example by virtue of the absence of the pilot tone signal, while he makes a brief announcement such as a moderation, and he can select a second illumination setting by means of the presence of the pilot tone signal while he is performing a singing performance. A light effect device and/or a fog machine can also be switched off by means of the absence of the pilot tone signal in order not to interfere with an announcement and can be switched on by the presence of the pilot tone signal to accompany a singing performance.

In accordance with a further aspect of the invention the receiving unit wirelessly receives the at least first audio signal, and the pilot tone signal. It is possible in that way to dispense with a cable or a signal line in order to feed the at least first audio signal and the pilot tone signal to the audio signal processing unit. That can save on the complication and expenditure which would be required for laying out the cable or the signal line. In addition cables or signal lines are unwanted in many cases because they spoil the look of a performance, they represent a risk of tripping over and they restrict the user of a microphone as the pickup unit in his freedom of movement.

In an aspect of the invention the pilot tone signal is transmitted to the audio signal processing unit in time multiplex, frequency multiplex or code multiplex. That is advantageous as different pickup units can be connected by means of the pilot tone signal in a time slot, a frequency slot or a code slot.

BRIEF DESCRIPTION OF THE DRAWINGS

FIG. 1 shows a diagrammatic view of a wireless audio signal transmission system.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIG. 1 shows a diagrammatic view of a wireless audio signal transmission system. The wireless audio signal transmission system has a pickup unit 10, an audio signal processing unit 20, an audio signal source 40, a loudspeaker 50 and an external switching device 55.

The audio signal processing unit 20 has a receiving unit 21 which wirelessly receives a first audio signal and a pilot tone signal from the pickup unit 10 such as for example a microphone. The receiving unit 21 outputs the received first audio signal and the received pilot tone signal to an audio signal treatment unit 22. The audio signal treatment unit 22 separates the two received signals from each other and outputs the first audio signal by way of a signal pre-processing unit 29 to an audio signal summing means 25 and the pilot tone signal to a pilot tone signal unit 23. The signal pre-processing unit 29 performs measures for signal processing as are used for example by an amplifier, an equalizer, an expander, a compressor, a noise gate and/or an automatic gain control.

In addition the audio signal processing unit 20 according to the invention, by way of an audio signal input 26, receives a second audio signal from the audio signal source 40 which in relation to the audio signal processing unit 20 is an external device such as for example a CD player or a DVD player or another audio signal source. The second audio signal is passed from that audio signal input 26 to a first audio signal amplifier 30 which is also capable of performing measures for signal processing like those for example of an amplifier, an equalizer, an expander, a compressor, a noise gate and/or an automatic gain control.

The output signal of the first audio signal amplifier 30 is then fed to the audio signal summing means 25 which sums that second audio signal with the first audio signal. The summed audio signal is amplified as a whole independently of frequency by a second audio signal amplifier 33 and outputted by way of an audio signal output 28 from the audio signal processing unit 20, for example to a final stage amplifier and/or the loudspeaker 50.

The pilot tone signal unit 23 evaluates the pilot tone signal in respect of its presence or absence and outputs a corresponding control signal to a microcontroller 24. That is coupled by way of a control line to the first audio signal amplifier 30 and the second audio signal amplifier 33 and is capable of controlling the respective amplification gain or the frequency selection of the first audio signal amplifier 30 and the second audio signal amplifier 33. The microcontroller 24 is also capable by way of a control signal output 27 to output a further control signal to the external switching device 55 such as for example a lighting installation, a light effect device or a fog machine or the like, in dependence on the presence or absence of the pilot tone signal. In that respect both functions, that is to say influencing the second audio signal and outputting an external control signal can be implemented in the audio signal processing unit according to the invention, in dependence on the presence or absence of the pilot tone signal, or also only one of those two functions can be performed.

The audio signal processing unit according to the invention can be used to receive a speech signal as well as a pilot tone signal from the pickup unit 10. The two signals of the speech signal and the pilot tone signal are received by way of the receiving unit 21 and separated by way of the audio signal treatment unit 22. The control signal corresponding to the presence or absence of the pilot tone signal is fed by the pilot tone signal unit 23 to the microcontroller 24 which for example on the basis of the presence of the pilot tone signal detects that for example a first control state of the first audio signal amplifier 30 and the second audio signal amplifier 33 is desired by the user of the pickup unit 10. That can be for example full amplification of the full frequency spectrum of the second audio signal which for example can be reproduction of a piece of music. The first and the second audio signals are correspondingly summed and outputted. If in that case the pickup unit 10 is not used for speech input by the user, then only the second audio signal of the music is outputted by way of the loudspeaker 50—apart from background noises and the like which are possibly picked up by the pickup unit 10. At the same time or alternatively an external device can also be actuated by the control signal by way of the output 27 and switched over between two states.

If now the user of the pickup unit 10 would like for example to make an announcement which is not to be disturbed by the music of the second audio signal and/or light effects or fog he can for example interrupt the pilot tone signal by way of the pickup unit 10, for example by actuating a button or a switch on the pickup unit 10, or switch off the pickup unit 10 as a whole and thereby interrupt both the pilot tone signal and also the first audio signal. The microcontroller 24 detects that absence of the pilot tone signal by way of the corresponding one control signal of the pilot tone signal unit 23 and initiates a reaction to the absence of the pilot tone signal in accordance with a pre-setting which was previously made for that situation by the user at the audio signal processing unit 20. In that case that can involve actuation of the first audio signal amplifier 30 such as to completely attenuate the second audio signal and thereby produce muting, that is to say a so-called mute function, in respect of the music of the second audio signal so that the voice of the user is not superimposed by the music of the second audio signal. At the same time or alternatively a control signal can be outputted by the microcontroller 24 by way of the output 27 in order to shut down or interrupt a fog machine or a light effect device or to switch over a light control from one illumination setting into a second illumination setting.

When the user, after his announcement, again actuates the button or the switch or again releases the button or the switch or switches on the pickup unit 10 again as a whole so that the pilot tone signal is again transmitted, that is detected by the microcontroller 24 by virtue of the corresponding different control signal of the pilot tone signal unit 23 and the previous state of actuation is restored, that is to say the music of the second audio signal is outputted again by way of the loudspeaker 50, summed with the first audio signal, and/or the fog machine or the light effect device is switched on again or the arrangement is changed back to the previous illumination setting.

In a further possible use the audio signal processing unit 20 can be set by the user in such a way that, in the absence of the pilot tone signal, it fades out only a given frequency range of the second audio signal, for example the speech range of the music performance, by the incoming second audio signal being admittedly completely amplified by the first audio signal amplifier 30 but at the same time being filtered in respect of the speech frequencies so that only the other frequencies are outputted to the audio signal summing means 25.

When now the user actuates the button or the switch of the pickup unit 10, the microcontroller 24 reacts in accordance with the pre-setting and the music filtered in respect of the speech component is outputted by way of the loudspeaker 50 as the second audio signal. In that way a karaoke function can be implemented by means of the audio signal processing unit according to the invention.

The concept of the invention concerns the control of an external audio input in a stationary wireless microphone receiver by means of a pilot tone signal evaluator. Microphone receivers, preferably stationary wireless microphone receivers, active loudspeakers with incorporated microphone receiver, preferably active mobile loudspeakers with incorporated microphone receiver, audio cascading of microphone receivers, switching of effects by means of microphone receivers and small and simple karaoke applications, preferably those in stereo and with better signal processing, can be envisaged as fields of application of the invention.

In that respect the purpose of the invention is to provide for control of an external audio input in respect of level and possibly sound, for example by means of equalizers, and to provide a common output by way of an audio output together with the audio signal of the wireless microphone. Additionally or alternatively an external control signal can be provided, depending on the respective signal of the pilot tone signal evaluator of the microphone receiver, for the control of external devices.

That is intended to provide for the implementation of an audio input in a wireless receiver with the option of being able to adjust the level (gain and attenuation) and possibly also sound (equalizer). In addition there is to be provided software adaptation and enlargement of the menu structure for controlling the new control elements in accordance with the demands involved on the basis of the pilot tone signal together with a squelch threshold, that being available to the microcontroller. The invention also seeks to provide a level evaluator for the external audio signal source and a stereo input and output with a selection option as to whether the microphone is summed on both or only on one channel. There is also provided a switching output which provides an output signal in respect of the pilot tone evaluator, that is protected from reverse polarity, short-circuit and ESD.

For that purpose in accordance with the invention there is provided an audio input (for example XLR or latch connector) with a downstream-connected adjustable LF-level adaptation and an adjustable equalizer and a further adjustable level adaptation including a mute function, the audio signal of which is then summed onto the output stage of the receiver at that time. At that time, the microcontroller already detects the pilot tone signal or a mute flag in the digital data stream. According to the invention the microcontroller now controls the sound and level depending on the respective state of the pilot tone signal (present/absent) in accordance with user presettings by way of a menu or a remote control tool (for example WSM).

For that purpose the user can store presets for both states:

for wireless microphones the respective level (possibly mute) and possibly also sound (LowCut, HiBoost and the like);

for external audio signal sources the respective level (possibly mute) and possibly also sound (Equalizer).

At the same time a switching output can be made available with the state of the pilot tone signal to control external devices or functions such as for example effects.

A very simple (inexpensive) karaoke function is possible by virtue of an equalizer for the external audio signal source, by the mean frequency range of the external audio signal source being faded out or lowered, whereby the voice of the user becomes more strongly audible by way of the wireless microphone. An improved karaoke function would be possible with stereo inputs and outputs.

Further possible options provide for using a level display of the external audio source on the display of the receiver for setting the correct volume. It is also possible to provide AGC (active gain control) for a microphone and/or an external audio input to compensate for audio level changes due to holding the microphone differently (in the case of the microphone that would have to be appropriately implemented in SK/SKM). In addition parts of the control, sound and level processing for that purpose can also be moved into a DSP instead of HW and microcontroller. In addition it is possible to use pilot tone-like signals which come from the wireless microphone like a mute flag in digital systems for evaluation purposes.

This invention provides that the volume of the external audio source has to be set only once for both of the pilot tone signal states and the user can determine the level and can thus provide for example for reducing the background music by switching the microphone on/off or by pressing the mute button on the transmitter without for that purpose requiring a mixing console or having to directly operate such a console. Multiple-channel receiver systems can be implemented by cascading a plurality of wireless receivers by means of the external audio input without an external mixing console being required. Here too the whole has to be set only once. The switching output also affords the possibility of controlling effects (spotlight etc.) which otherwise only react to acoustic stimuli (for example clapping-induced light switching).

While this invention has been described in conjunction with the specific embodiments outlined above, it is evident that many alternatives, modifications, and variations will be apparent to those skilled in the art. Accordingly, the preferred embodiments of the invention as set forth above are intended tote illustrative, not limiting. Various changes may be made without departing from the spirit and scope of the inventions as defined in the following claims.

The invention claimed is:

1. An audio signal processing unit comprising:

a receiving unit configured to receive at least a pilot tone signal and a first audio signal from a first audio signal source comprising a wireless microphone;

a first audio signal amplifier configured to obtain at least a second audio signal, which is different from the first audio signal, from an external second audio signal source by way of an audio signal input; and a pilot tone signal unit configured to:

obtain the pilot tone signal;

output a control signal in a first state if the pilot tone signal is received; and output the control signal in a second state if the pilot tone signal is not received;

wherein the first audio signal amplifier is further configured to process the at least second audio signal depending on the state of the control signal, so that:

when the control signal in the first state is outputted by the pilot tone signal unit, the first audio signal amplifier amplifies or attenuates the at least second audio signal with a first level; and when the control signal in the second state is outputted by the pilot tone signal unit, the first audio signal amplifier amplifies or attenuates the at least second audio signal with a second level that is different from the first level.

2. The audio signal processing unit as set forth in claim 1;

wherein the first audio signal amplifier, in accordance with the first state of the control signal, is further configured to:

perform filtering with a first frequency spectrum; and wherein the first audio signal amplifier, in accordance with the second state of the control signal, is further configured to:

perform filtering with a second frequency spectrum.

3. The audio signal processing unit as set forth in claim 1;
wherein the first audio signal amplifier is configured to completely suppress the at least second audio signal.

4. The audio signal processing unit as set forth in claim 1, further comprising:
an audio signal summing means configured to:
obtain the at least second audio signal from the first audio signal amplifier; and
to sum the at least first audio signal and the at least second audio signal.

5. The audio signal processing unit as set forth in claim 4, further comprising:
a second audio signal amplifier configured to:
obtain the summed audio signal from the audio signal summing means; and
amplify, attenuate, and/or filter the summed audio signal.

6. The audio signal processing unit as set forth in claim 1, further comprising:
an audio signal treatment unit configured to:
obtain the at least first audio signal and the received pilot tone signal from the receiving unit;
output the at least first audio signal to the audio signal summing means; and
output the received pilot tone signal to the pilot tone signal unit.

7. An audio signal processing unit comprising:
a first receiving unit configured to receive at least a pilot tone signal and a first audio signal from a first audio signal source comprising a wireless microphone;
a second receiving unit configured to receive at least a second audio signal, which is different from the first audio signal, from an external second audio signal source by way of an audio signal input;
a pilot tone signal unit configured to:
obtain the pilot tone signal;
output a control signal in a first state by way of an output of the audio signal processing unit if the pilot tone signal is received; and
output the control signal in a second state by way of the output of the audio signal processing unit if the pilot tone signal is not received; and
a processing unit configured to process the at least second audio signal depending on the state of the control signal, so that;
when the control signal in the first state is outputted by the pilot tone signal unit, the processing unit amplifies or attenuates the at least second audio signal with a first level; and
when the control signal in a second state is outputted by the pilot tone signal unit, the processing unit amplifies or attenuates the at least second audio signal with a second level that is different from the first level.

8. The audio signal processing unit as set forth in claim 7;
wherein, in accordance with the first state of the control signal, an external switching device connected to the output of the audio signal processing unit is put into a first state; and
wherein, in accordance with the second state of the control signal, the external switching device connected to the output of the audio signal processing unit is put into a second state.

9. The audio signal processing unit as set forth in claim 7;
wherein the receiving unit is configured to wirelessly receive the at least first audio signal and the pilot tone signal.

10. The audio signal processing unit as set forth in claim 9;
wherein the pilot tone signal is transmitted to the audio signal processing unit in time multiplex, frequency multiplex, or code multiplex.

11. An audio signal transmission system comprising:
at least one pickup unit configured to:
detect at least a first audio signal and a pilot tone signal; and
wirelessly transmit the first audio signal and the pilot tone signal; and
an audio signal processing unit as set forth in claim 1 configured to receive the at least first audio signal transmitted from the pickup unit and the pilot tone signal;
wherein the pickup unit is configured to interrupt the transmission of the pilot tone signal.

12. The audio signal transmission system as set forth in claim 11;
wherein the audio signal transmission system is a wireless audio signal transmission system for wireless audio transmission with at least a wireless pickup unit.

13. An audio signal processing method comprising:
receiving at least a pilot tone signal and a first audio signal from a first audio signal source comprising a wireless microphone;
receiving at least a second audio signal, which is different from the first audio signal, from an external second audio signal source; and
processing the at least second audio signal depending on a state of a control signal, which indicates the presence or the absence of the pilot tone signal;
wherein, when the pilot tone signal is present, the second audio signal is amplified or attenuated with a first level; and
wherein, when the pilot tone signal is absent, the second audio signal is amplified or attenuated with a second level that is different from the first level.

14. An audio signal transmission system comprising:
at least one pickup unit configured to:
detect at least a first audio signal and a pilot tone signal; and
wirelessly transmit the first audio signal and the pilot tone signal; and
an audio signal processing unit as set forth in claim 7 configured to receive the at least first audio signal transmitted from the pickup unit and the pilot tone signal;
wherein the pickup unit is configured to interrupt the transmission of the pilot tone signal.

15. The audio signal transmission system as set forth in claim 11;
wherein the audio signal transmission system is a wireless audio signal transmission system for wireless audio transmission with at least a wireless pickup unit.

* * * * *